US007591434B2

(12) United States Patent
Ando

(10) Patent No.: US 7,591,434 B2
(45) Date of Patent: Sep. 22, 2009

(54) HOT WATER SUPPLY SYSTEM

(75) Inventor: Masakazu Ando, Nagoya (JP)

(73) Assignee: Rinnai Corporation, Nagoya-Shi (JP)

( * ) Notice: Subject to any disclaimer, the term of this patent is extended or adjusted under 35 U.S.C. 154(b) by 662 days.

(21) Appl. No.: 11/259,123

(22) Filed: Oct. 27, 2005

(65) Prior Publication Data

US 2007/0108306 A1 May 17, 2007

(51) Int. Cl.
*F22B 37/36* (2006.01)

(52) U.S. Cl. ..... 237/56; 122/494

(58) Field of Classification Search ..... 122/497–500, 122/494, 14.1, 14.2; 220/567.3, 495.01, 220/694.1

See application file for complete search history.

(56) References Cited

U.S. PATENT DOCUMENTS 5,163,119 A * 11/1992 Windon ..... 392/449

6,371,057 B1 * 4/2002 Henderson ..... 122/14.2

FOREIGN PATENT DOCUMENTS

JP 64-53858 U 4/1989
JP 2005-195246 A 7/2005

* cited by examiner

*Primary Examiner*—Steven B McAllister
*Assistant Examiner*—Robert E Thomas
(74) *Attorney, Agent, or Firm*—Birch, Stewart, Kolasch & Birch, LLP

(57) ABSTRACT

A hot water supply system includes: a casing 1 having an opening in a front face; a front panel 2 covering the front face of the casing; and a console box 7 attached to the casing. The front panel has a window into which the console box is to be fitted. The clearance between the window and the console box is eliminated to improve the appearance of the system, and it is provided that the front panel can be attached to the casing without problems. In order to eliminate the clearance between the window 20 and the console box 7, the window 20 has a size enough for the console box 7 to be tightly fitted therein. In order that the console box 7 fitted in the window 20 can move vertically and horizontally together with the front panel 2, a support plate 8 for the console box 7 is attached to the casing 1 with a vertical and a horizontal play.

2 Claims, 4 Drawing Sheets

HOT WATER SUPPLY SYSTEM

BACKGROUND OF THE INVENTION

1. Field of the Invention

The present invention relates to a hot water supply system. More particularly, it relates to a hot water supply system that comprises a casing having an opening in the front face and a front panel covering the front face of the casing, in which a console box for making various settings, such as setting of the hot water temperature, is attached to the casing.

2. Description of the Related Art

Conventionally, such a hot water supply system has its console box fixed to the casing. The front panel has a window for exposing the console box, and once the front panel is attached to the casing, the console box is fitted into the window (see Japanese Utility Model Laid-Open No. 64-53858, for example).

The window of the conventional hot water supply system described above has to be somewhat larger than the contour of the console box, in order that the console box can be fitted into the window even if a misalignment occurs between the front panel and the console box. Thus, there exists a clearance between the console box and the window. When a misalignment occurs between the console box and the front panel, the clearance between the console box and the window is not uniform around the perimeter of the console box, which compromises the appearance of the system.

In order to overcome the disadvantage, according to a conventional known approach, after the console box is fitted into the window of the front panel, a cover having an opening into which the console box is to be fitted is attached onto the front face of the front panel (see Japanese Patent Laid-Open No. 2005-195246, for example).

According to this approach, even if the clearance between the perimeter of the console box and the window is not uniform because of a misalignment between the front panel and the console box, the clearance is hidden by the cover and cannot be seen from the outside, so that the appearance of the system is not degraded. However, since this approach additionally requires the cover, the number of components increases, and the production cost also increases.

SUMMARY OF THE INVENTION

In view of such circumstances, an object of the present invention is to provide a hot water supply system that is inexpensive, has a simple structure and does not use a cover while preventing appearance degradation.

In order to attain the object described above, the present invention provides a hot water supply system, comprising: a casing having an opening in a front face; a front panel covering the front face of the casing; and a console box attached to the casing, a window into which the console box is fitted being formed in the front panel, in which the window has a size enough for the console box to be tightly fitted therein, and the console box is attached to the casing with a vertical and a horizontal play.

According to the present invention, since the console box is tightly fitted into the window, little clearance is produced between the window and the console box, and the appearance of the system is not degraded because of nonuniform clearance. Therefore, the system can have a good appearance without any cover used in the conventional system described above, so that the structure of the system can be simplified, and the production cost can be reduced.

If the console box is fixed to the casing, a misalignment between the front panel and the console box, which inevitably occurs because of mounting tolerance or the like, causes the console box to interfere with the perimeter of the window, and thus, the front panel cannot be attached to the casing. However, according to the present invention, the console box is attached to the casing with a vertical and a horizontal play. Thus, when attaching the front panel to the casing, the console box fitted in the window can move together with the front panel moving vertically and horizontally to be aligned with the casing. Therefore, the front panel can be attached to the casing with the console box fitted in the window with reliability and without problems.

Using the remote controller for the hot water supply system as the console box eliminates the need to fabricate a dedicated console box and thus is advantageous in cost. However, the remote controller is designed to be screwed to house walls, so that it is difficult to attach the console box, which is constituted by such a remote controller, to the casing with a vertical and a horizontal play. In this case, if a support plate for the console box is attached to the casing with a vertical and a horizontal play, and the console box is fixed to the support plate, the console box can move vertically and horizontally with respect to the casing. Thus, the remote controller can be used as the console box as it is.

Furthermore, in the case where the support plate is attached to the casing with a vertical and a horizontal play in this way, it is desirable that inward-bent flanges are formed at least on one horizontal side edge and a lower edge of the front face of the casing, the inward-bent flange on the side edge has an engaging opening, and the support plate has a first engaging portion that is to be engaged with the engaging opening with a vertical and a horizontal play and a second engaging portion that is to be engaged with the inward-bent flange on the lower edge in such a manner that the second engaging portion sandwiches the inward-bent flange from the front and back thereof.

In this case, due to the play of the first engaging portion engaged with the engaging opening, the support plate can move vertically and horizontally with respect to the casing. If the support plate has only the first engaging portion, the support plate pivots back and forth with respect to the casing about the first engaging portion engaged with the engaging opening, and thus, it is difficult to attach the front panel to the casing. However, if the support plate has the second engaging portion as described above, the support plate is prevented from pivoting, and the disadvantage described above can be avoided. In addition, according to this arrangement, there is no need of providing any bracket for attaching the support plate to the casing, so that the structure of the system is simplified. In addition, the inward-bent flanges are covered with the front cover, so that the first and second engaging portions and the engaging openings are also covered with the front cover and cannot be seen from the outside, and thus, the appearance of the system is not degraded.

When a switch or the like on the console box is pressed, the pressing force exerted on the console box is received by the inward-bent flanges via the support plate. However, there still remains a possibility that an upper part of the support plate is bent backward, and the console box retracts backward. In this case, if the support plate has an abutment portion that is to abut against the front face of a device housed in the casing, the support plate is prevented from being bent, so that the console box can be advantageously prevented from retracting backward.

DETAILED DESCRIPTION OF THE PREFERRED EMBODIMENTS

Figure 1:
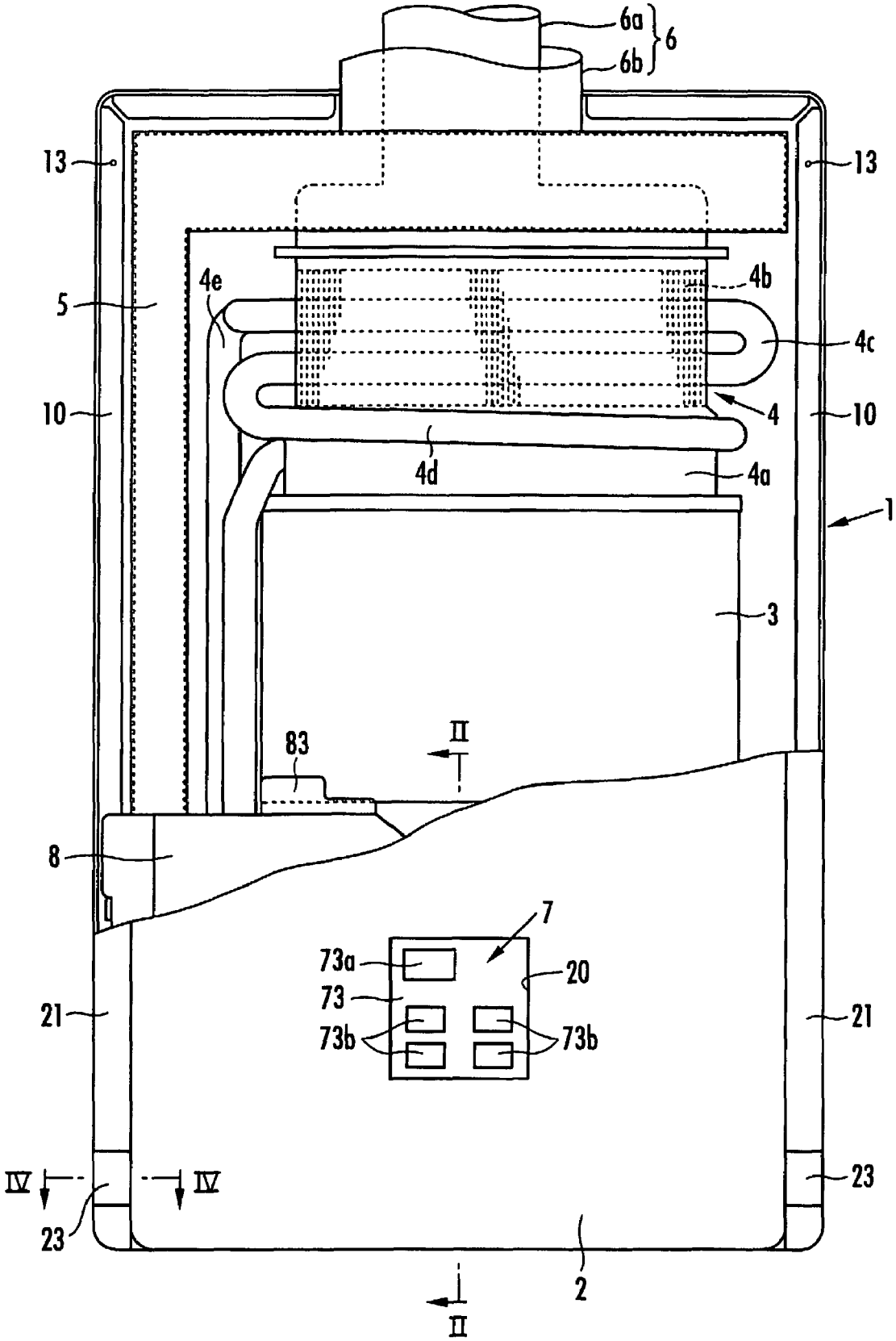
FIG. 1 is a front view of a hot water supply system according to an embodiment of the present invention shown with a part of a front panel cut away.

Referring to FIG. 1, reference numeral 1 denotes a casing of a hot water supply system. The casing 1 is in the shape of a box having its front face opened, and the front face of the casing 1 is covered with a front panel 2. In the casing 1, there are provided a combustion housing 3 housing a burner (not shown) and a heat exchanger 4 disposed on top of the combustion housing 3 and coupled to the combustion housing 3. The heat exchanger 4 comprises a trunk section 4*a* constituting a combustion chamber coupled to the combustion housing 3 and a heat sink section 4*b* having a plurality of fins that is mounted on top of the trunk section 4*a*. The heat sink section 4*b* has a serpentine heat-sink pipe 4*c*, which is connected to a water supply pipe 4*d* on the upstream side and is connected to a hot water supply pipe 4*e* on the downstream side. When water flows from the water supply pipe 4*d* to the hot water supply pipe 4*e*, the water is heated in the heat sink section 4*b* by the action of exhaust gas from the burner.

In addition, in the casing 1, there is provided an air supply duct 5 that extends from above the heat exchanger 4 to a combustion fan (not shown) located at the bottom of the combustion housing 3. At the top of the casing 1, there is provided an air supply and exhaust pipe unit 6 of a double-pipe structure that comprises an inner pipe 6*a* coupled to the heat exchanger 4 and an outer pipe 6*b* coupled to the air supply duct 5. The exhaust gas from the burner is discharged from the heat exchanger 4 to the outside via the inner pipe 6*a*, and the outside air is supplied into the combustion housing 3 as combustion air via the outer pipe 6*b*, the air supply duct 5 and the combustion fan.

Figure 2:
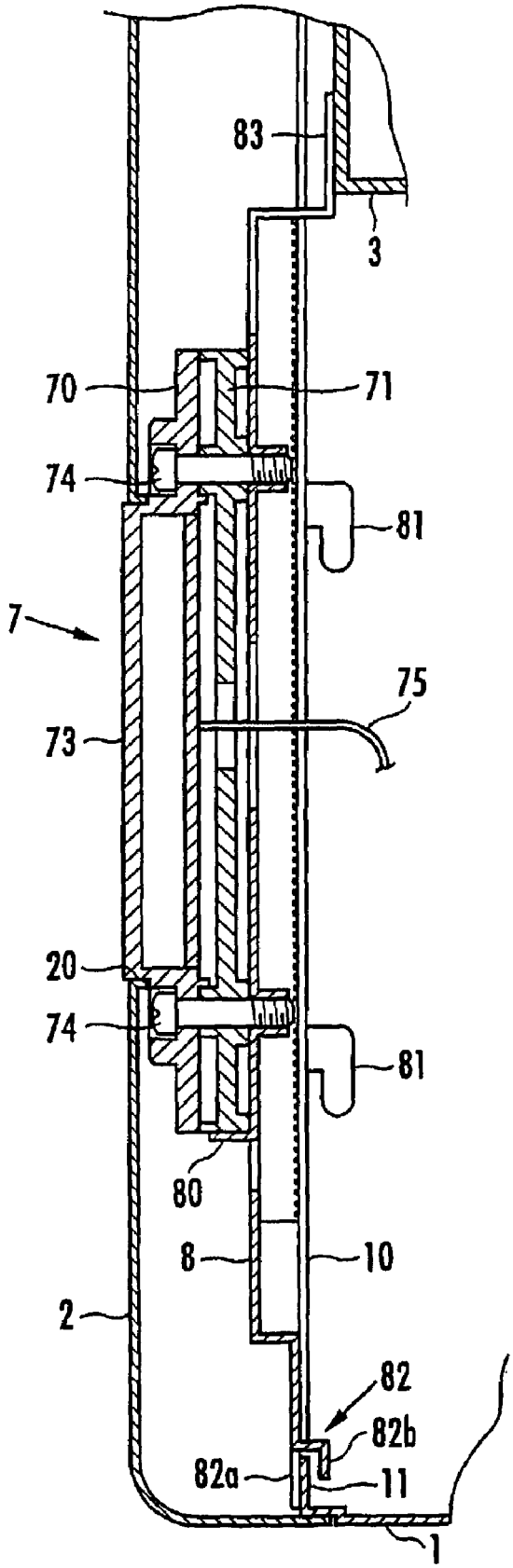
FIG. 2 is a cross sectional view of the hot water supply system taken along the line II-II in FIG. 1.
Figure 3:
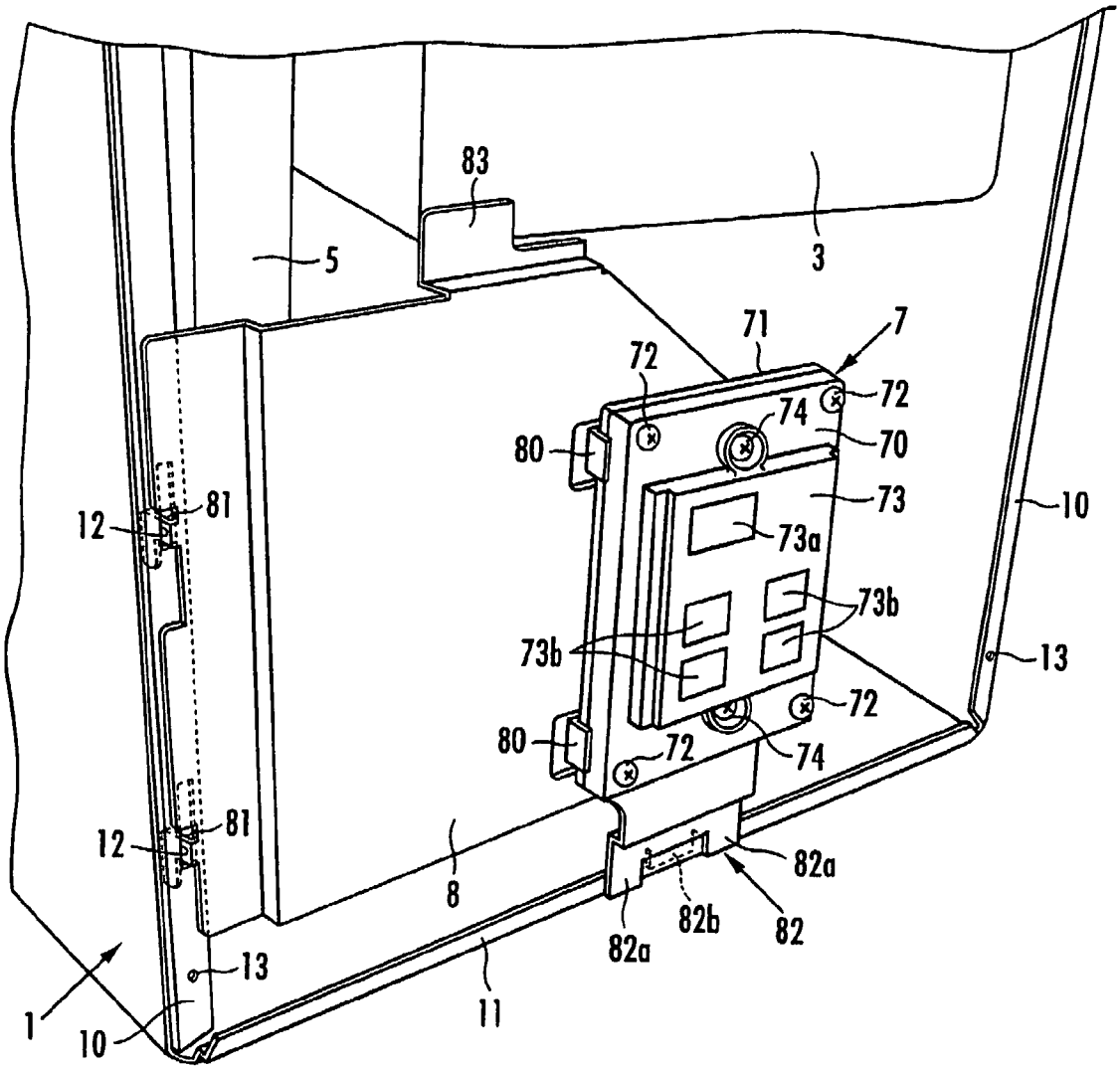
FIG. 3 is a perspective view of essential components of the hot water supply system according to the embodiment shown with the front panel removed.

In addition, a console box 7, which is the same as a remote controller for the hot water supply system, is attached to the casing 1 at a lower and horizontally middle position in the front face thereof. The front panel 2 has a window 20 for the console box, and the console box 7 is fitted into the window 20. As shown in FIGS. 2 and 3, the console box 7 is assembled from a box main body 70 and a back lid 71 fastened to each other with a screw 72. The box main body 70 has a console section 73 protruding frontward in the middle area of the front face thereof, and the console section 73 has a display portion 73*a* and a variety of operation buttons 73*b*. Furthermore, the console box 7 is fixed to a support plate 8 attached to the casing 1 with a screw 74. The support plate 8 has raised claws 80 that abut against the side face and the bottom face of the console box 7. Fastening of the console box 7 to the support plate 8 with the screw 74 can be accomplished with the console box 7 being roughly positioned by the raised claws 80. Furthermore, the console box 7 is connected to a controller (not shown) in the casing 1 via a lead line 75 drawn from the back side thereof, and the various settings, such as setting of the hot water temperature, made through manipulations of the operation buttons 73*b* are transmitted to the controller.

The window 20 has a size adjusted to that of the console section 73, and the console section 73 of the console box 7 is fitted into the window 20. Thus, there is little clearance between the console section 73 and the window 20, so that the disadvantage that nonuniform clearance between the console section 73 and the window 20 compromises the appearance of the hot water supply system is avoided.

However, in the case where the window 20 has a size enough for the console section 73 to be tightly fitted therein, if the console box 7 is fixed to the casing 1, a misalignment between the front panel 2 and the console box 7, which inevitably occurs because of mounting tolerance or the like, causes the console box 7 to interfere with the perimeter of the window 20, and thus, the front panel 2 cannot be attached to the casing 1.

In order to overcome the disadvantage, according to this embodiment, the support plate 8 is attached to the casing 1 with a vertical and a horizontal play. Thus, the console box 7 is attached to the casing 1 via the support plate 8 with the same plays. In this case, when attaching the front panel 2 to the casing 1, the console box 7 fitted in the window 20 can move together with the front panel 2 moving vertically and horizontally to be aligned with the casing 1. Thus, the front panel 2 can be attached to the casing 1 with the console box 7 fitted in the window 20 with reliability and without problems.

Now, attachment of the supporting plate 8 to the casing 1 will be described. The casing 1 has inward-bent flanges 10, 10 formed on both vertical side edges of the front face thereof and an inward-bent flange 11 bent upward formed on the lower edge of the front face of the casing 1. A vertical pair of engaging openings 12, 12 are formed in one of the vertical side edges, specifically, the left-hand inward-bent flange 10 in FIG. 3. A vertical pair of first engaging portions 81, 81, which are in the shape of a claw and to be engaged with the engaging openings 12, 12, are formed on the left-hand side edge of the support plate 8. Each engaging opening 12 is in the shape of a vertically elongated slit and has a width larger than the thickness of the first engaging portion 81. Therefore, each first engaging portion 81 is engaged with the corresponding engaging opening 12 with a vertical and a horizontal play.

In addition, the support plate 8 has, on the lower edge thereof, a second engaging portion 82 that is to be engaged with the inward-bent flange 11 of the lower edge of the casing 1 in such a manner that the second engaging portion 82 sandwiches the inward-bent flange 11 from the front and back sides thereof. Thus, the support plate 8 can be prevented from pivoting back and forth with respect to the casing 1 about the first engaging portions 81 engaged with the engaging openings 12. The second engaging portion 82 comprises a horizontal pair of front pieces 82*a*, 82*a* capable of abutting against the front face of the inward-bent flange 11 and a bent rear piece 82*b* that is formed between the engaging pieces 82*a* and 82*a* and can abut against the back face of the inward-bent flange 11. The inward-bent flange 11 is sandwiched between the front pieces 82*a*, 82*a* and the rear piece 82*b*. The second engaging portion 82 can move horizontally with respect to the inward-bent flange 11 and can move vertically from a position where the upper horizontal region of the bent rear piece 82*b* abuts against the upper edge of the inward-bent flange 11.

According to the arrangement described above, the support plate 8 can move vertically and horizontally with respect to the casing 1 by the play between the engaging opening 12 and the first engaging portion 81. Thus, the console box 7 can move vertically and horizontally together with the front panel 2 while being kept fitted in the window 20, so that the front panel 2 can be attached to the casing 1 with reliability. In addition, the inward-bent flanges 10, 11 of the casing 1 are covered with the front panel 2. Therefore, the first engaging portions 81, the second engaging portion 82 and the engaging openings 12 are also covered with the front panel 2 and cannot be seen from the outside, and thus, the appearance of the system is not degraded. In addition, since the inward-bent flanges 10, 11 are used for attaching the support plate 8 to the casing 1, there is no need of providing any bracket dedicated to attachment of the support plate 8 to the casing 1, and thus, the structure of the system is simplified.

When an operation button 73*b* on the console box 7 is pressed, a backward pressing force is applied to the console box 7. The pressing force is received by the inward-bent flanges 10, 11 via the support plate 8. However, there still remains a possibility that an upper part of the support plate 8 is bent backward, and the console box 7 retracts backward. Thus, according to this embodiment, the support plate 8 has, on the upper edge thereof, an abutment portion 83 that is to abut against a lower region of the front face of the combustion housing 3 that is housed in the casing 1. Thus, the pressing force is absorbed also by the combustion housing 3 via the abutment portion 83, so that it is possible to prevent the support plate 8 from being bent and the console box 7 from retracting backward.

Figure 4:
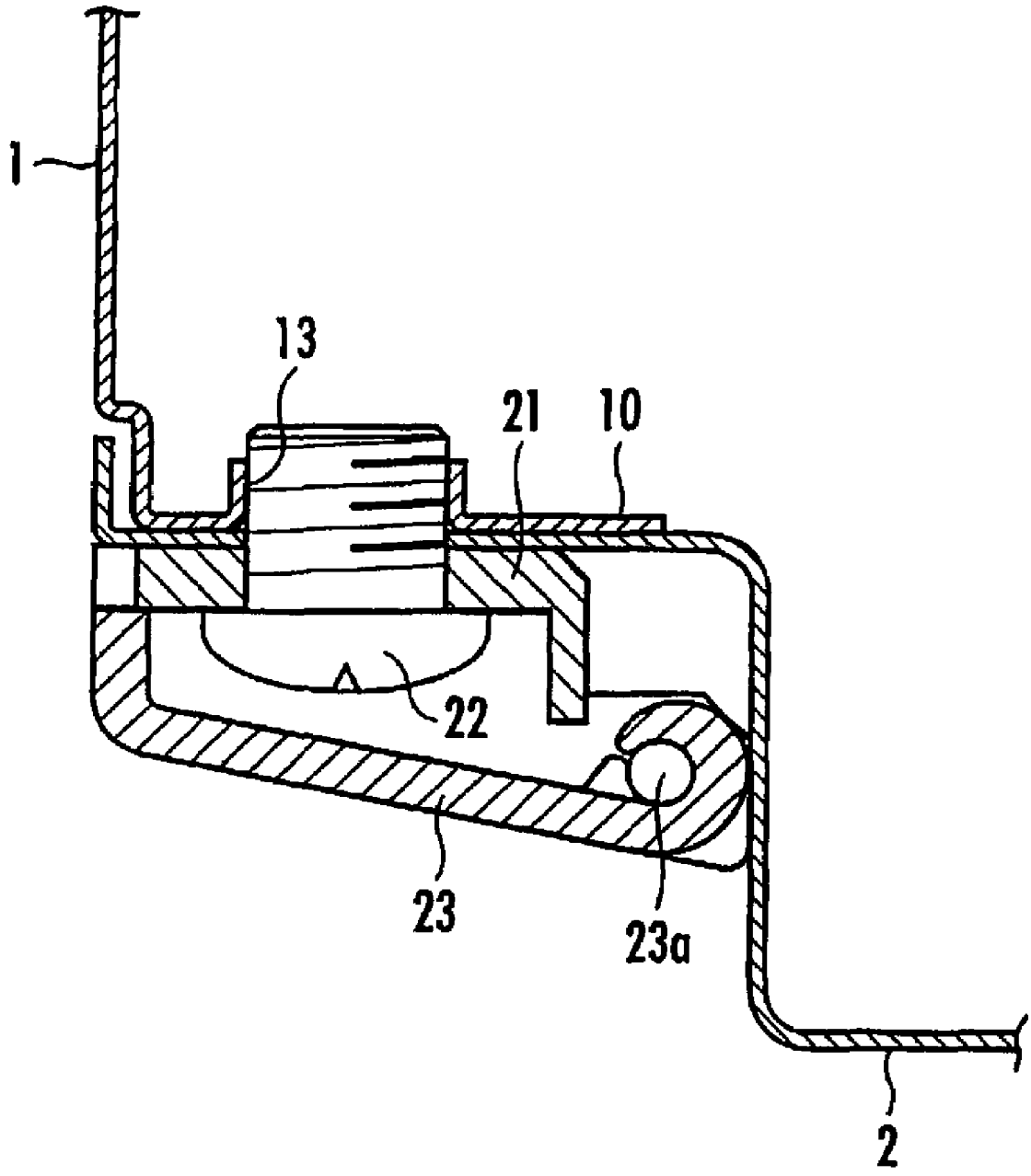
FIG. 4 is a cross sectional view of the hot water supply system taken along the line IV-IV in FIG. 1.

Now, attachment of the front panel 2 to the casing 1 will be described. Two threaded holes 13, 13 arranged vertically are formed in each of the inward-bent flanges 10, 10 formed on the vertical side edges of the casing 1. A frame member 21, which also serves a decorative purpose, is mounted on the front face of each of the vertical side edges of the front panel 2 facing the inward-bent flanges 10. As shown in FIG. 4, a fixing screw 22 is screwed into the threaded hole 13 via openings in the frame member 21 and the front panel 2, thereby fastening the front panel 2 to the casing 1.

In this state, the fixing screw 22 can be seen from the outside, so that the appearance of the system is degraded. Thus, a cap 23 for covering the fixing screw 22 is provided at the screwed area of the frame member 21. The cap 23 has its horizontally inner end pivoted to the frame member 21 by a pin 23*a* so that the cap 23 can be opened and closed. Thus, the fixing screw 22 can be fastened with the cap 23 opened, and then the cap 23 can be closed to cover the fixing screw 22, thereby preventing from the appearance of the system from being degraded.

While an embodiment of the present invention has been described above with reference to the drawings, the present invention is not limited thereto. For example, while the remote controller is used as the console box 7 in the embodiment described above, a specially designed console box may be used. In this case, the support plate 8 may be fixed to the casing 1, and a claw-shaped piece formed on the back face of the console box 7 may be engaged with an engaging opening formed in the support plate 8 with a vertical and a horizontal play, thereby making the console box 7 capable of moving vertically and horizontally with respect to the casing 1.

What is claimed is:

1. A hot water supply system, comprising:

a hot water supply system casing having an opening in a front face;

a front panel covering the front face of said casing;

a console box attached to said casing, a window into which said console box is fitted formed in said front panel, wherein said window has a size enough for said console box to be tightly fitted therein providing substantially no vertical play, and said console box is attached to said casing with a vertical and a horizontal play;

a support plate for said console box is attached to said casing with a vertical and a horizontal play, and said console box is fixed to said support plate; and inward-bent flanges are formed at least on one horizontal side edge and a lower edge of the front face of said casing, the inward-bent flange on the side edge has an engaging opening, and said support plate has a first engaging portion that is to be engaged with said engaging opening with a vertical and a horizontal play and a second engaging portion that is to be engaged with the inward-bent flange on the lower edge in such a manner that the second engaging portion sandwiches the inward-bent flange from the front and back thereof.

2. The hot water supply system according to claim 1, wherein said support plate has an abutment portion that is to abut against a front face of a device incorporated in said casing.

* * * * *